US008443963B2

(12) United States Patent
Cooper et al.

(10) Patent No.: US 8,443,963 B2
(45) Date of Patent: May 21, 2013

(54) MULTIPLEXED GATHERING DEVICE AND METHOD

(75) Inventors: Gary Cooper, Nottingham, NH (US); Glenn Alan Guaraldi, Kingston, NH (US)

(73) Assignee: Goss International Americas, Inc., Durham, NH (US)

( * ) Notice: Subject to any disclaimer, the term of this patent is extended or adjusted under 35 U.S.C. 154(b) by 236 days.

(21) Appl. No.: 12/469,488

(22) Filed: May 20, 2009

(65) Prior Publication Data

US 2009/0292392 A1 Nov. 26, 2009

Related U.S. Application Data

(60) Provisional application No. 61/128,196, filed on May 20, 2008.

(51) Int. Cl.
*B65H 29/60* (2006.01)
*B65H 39/00* (2006.01)

(52) U.S. Cl.
USPC ..... 198/571; 270/52.16; 270/52.26; 270/52.29; 271/204; 271/205; 700/230

(58) Field of Classification Search
None
See application file for complete search history.

(56) References Cited

U.S. PATENT DOCUMENTS

| | | | | |
|---|---|---|---|---|
| 4,149,711 | A | 4/1979 | Jackson | 270/57 |
| 4,576,370 | A * | 3/1986 | Jackson | 270/52.03 |
| 4,626,672 | A | 12/1986 | Sapitowicz | 235/480 |
| 4,641,825 | A * | 2/1987 | Mowry et al. | 270/52.26 |
| 4,789,147 | A | 12/1988 | Berger et al. | 270/1.1 |
| 4,949,948 | A | 8/1990 | Petersen | 270/54 |
| 5,007,624 | A * | 4/1991 | Chandhoke | 270/58.2 |
| 5,013,022 | A | 5/1991 | Graushar | 270/56 |
| 5,050,106 | A | 9/1991 | Yamamoto et al. | 364/550 |
| 5,114,128 | A | 5/1992 | Harris, Jr. et al. | 270/11 |
| 5,174,454 | A | 12/1992 | Parkander | 209/3.3 |
| 5,207,412 | A | 5/1993 | Coons, Jr. et al. | 270/1.1 |
| 5,228,678 | A | 7/1993 | Matsuda et al. | 271/145 |
| 5,276,628 | A | 1/1994 | Schneiderhan | 364/478 |
| 5,317,654 | A | 5/1994 | Perry et al. | 382/61 |
| 5,377,120 | A | 12/1994 | Humes et al. | 364/478 |
| 5,439,209 | A | 8/1995 | Ruenzi | 271/251 |
| 5,445,271 | A | 8/1995 | Kakizaki et al. | 206/459.5 |
| 5,547,175 | A | 8/1996 | Graushar et al. | 270/37 |
| 5,651,798 | A | 7/1997 | Conboy et al. | 29/25.01 |
| 5,669,755 | A | 9/1997 | Zahn | 494/790.1 |

(Continued)

FOREIGN PATENT DOCUMENTS

| | | |
|---|---|---|
| EP | 0 386 787 A2 | 9/1990 |
| EP | 0 914 969 A2 | 11/1998 |
| WO | WO 96/40575 | 12/1996 |

*Primary Examiner* — Kavel Singh
(74) *Attorney, Agent, or Firm* — Davidson, Davidson & Kappel, LLC

(57) ABSTRACT

A multiplexing gathering device includes a first gatherer for forming first gathered printed products on a first line and a second gatherer for forming second gathered printed products on a second line. A collecting device collects the first and second gathered printed products. A first transporter transports the first gathered products from the first line to the collecting device and a second transporter for transports the second gathered products from the second line to the collecting device. At least one controller for controls the first gatherer and second gatherer so that second gathered products are selectively formed as a function of the formation of first gathered printed products. A method is also provided.

19 Claims, 2 Drawing Sheets

U.S. PATENT DOCUMENTS

| | | | | |
|---|---|---|---|---|
| 5,809,360 | A | 9/1998 | Blake et al. | 396/517 |
| 5,816,773 | A | 10/1998 | Fehringer et al. | 414/789.9 |
| 5,818,724 | A | 10/1998 | Brewster, Jr. et al. | 364/478.08 |
| 5,992,324 | A | 11/1999 | Rombult et al. | 101/477 |
| 6,000,695 | A | 12/1999 | Mack et al. | 271/303 |
| 6,192,295 | B1 | 2/2001 | Gunther | 700/225 |
| 6,612,559 | B2 * | 9/2003 | Boss | 270/52.18 |
| 2010/0019434 | A1 * | 1/2010 | Clarke et al. | 270/58.08 |

* cited by examiner

MULTIPLEXED GATHERING DEVICE AND METHOD

Priority is claimed to U.S. provisional application Ser. No. 61/128,196, filed on May 20, 2008, which is incorporated by reference herein.

BACKGROUND

The present invention relates generally to post-press devices and more particularly to gatherers and trimmers for printed products.

U.S. Pat. No. 5,669,755 discloses a device for the non-stop operation of a delivery unit of a rotary printing unit machine in which sheets are collated into individual stacks supported on a stack base with a surface interrupted by grooves and in which auxiliary stacks are borne by grid rods together forming a rack until their transfer to the stack base, the grid rods penetrating into the grooves during transfer.

U.S. Pat. No. 6,000,695 discloses a device for the transport of sheets in a stacking region. The device includes pneumatic guiding elements below the conveying path and extending across the entire width. A chain-conveyor system and a pneumatic conveyor system following the chain-conveyor system are provided. The device also provides for selectable paths to plural delivery positions.

BRIEF SUMMARY OF THE INVENTION

The present invention provides a multiplexing gathering device comprising a first gatherer for forming first gathered printed products on a first line, a second gatherer for forming second gathered printed products on a second line, a collecting device for collecting the first and second gathered printed products, a first transporter for transporting the first gathered products from the first line to the collecting device, a second transporter for transporting the second gathered products from the second line to the collecting device, and at least one controller for controlling the first gatherer and second gatherer so that second gathered products are selectively formed as a function of the formation of first gathered printed products.

Advantageously, two or more printed products from separate gathering lines thus may be placed next to each other on a separate collecting device, for example to permit them to be stacked and mailed together. The use of a separate collecting device and transporters permits more advantageous placement of books together, can shorten line lengths, and permit further processing separate from the gathering lines.

The present invention also provides a method for multiplexing gathered products comprising the steps of forming first gathered products on a first line, forming second gathered products on a second line as a function of the forming of the first gathered products, transporting the first gathered products from the first line to a collecting device, transporting the second gathered products from the second line to the collecting device, and collecting the first and second gathered products on the collecting device.

BRIEF DESCRIPTION OF THE DRAWINGS

A preferred embodiment of the present invention will be elucidated with reference to the drawings, in which.

DETAILED DESCRIPTION OF THE PREFERRED EMBODIMENTS

Figure 1:
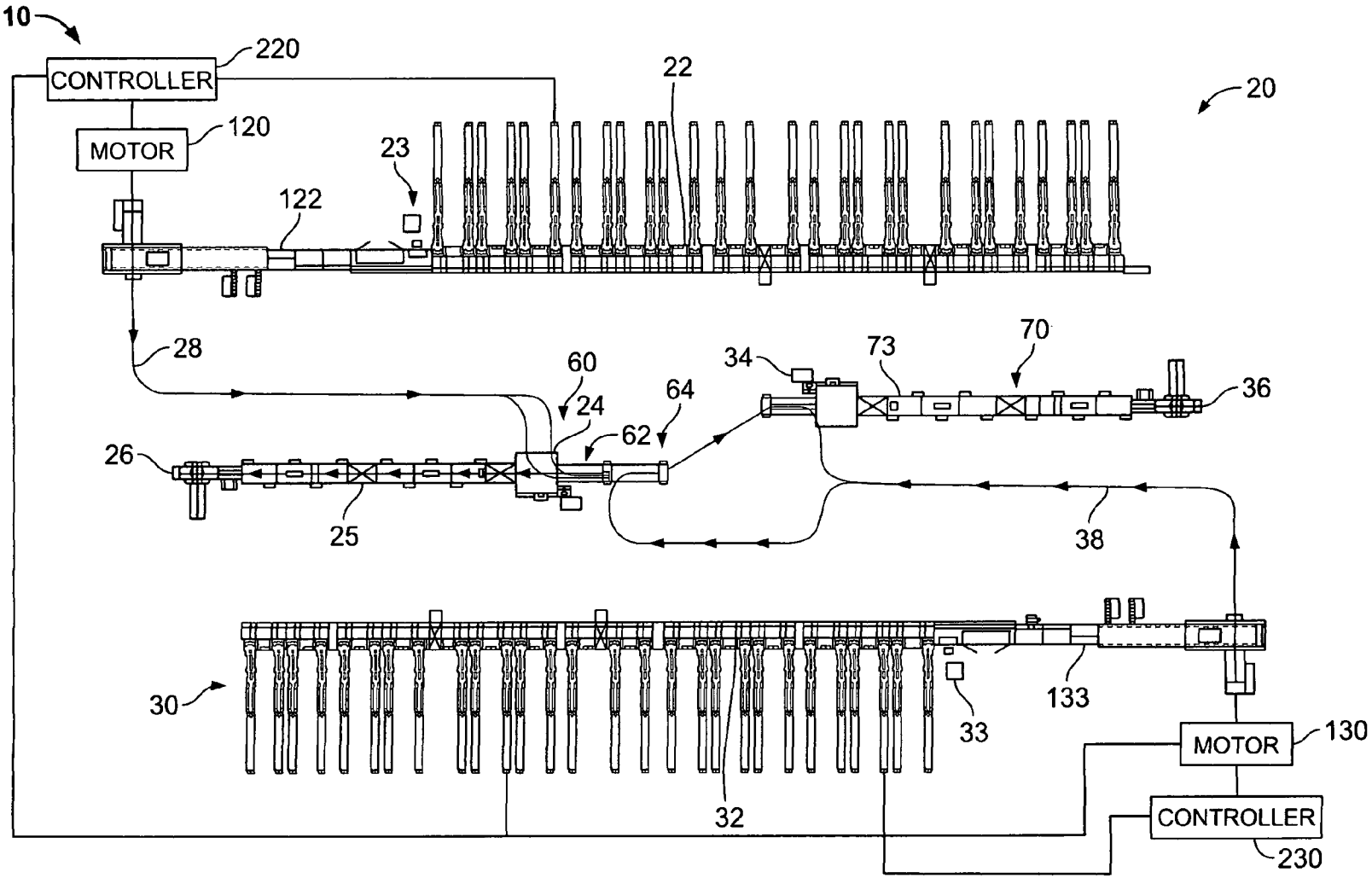
FIG. 1 shows a multiplexing gathering device according to an embodiment of the present invention.

FIG. 1 shows a first presently preferred embodiment of a multiplexing gathering device 10. The device 10 includes a first gatherer 20 and a second gatherer 30. Gatherer 20 in this embodiment may be a saddle stitcher, and includes a hopper section 22 having a plurality of hoppers, a stitcher 23 and a binding line 122. Gatherer 20 can collect printed products from the hoppers and bind them together into books. A transport device 28, for example a gripper conveyor, can take the books from the binding line 122, and transfer them to a collecting device 60. Collecting device 60 may include a trimmer 24, a conveyor 25 and a stacker 26, and have two receipt locations 62, 64 for receiving, respectively, the books from gatherer 20 and other books from a separate gatherer 30. Gatherer 30 in this embodiment may also be a saddle stitcher and includes a hopper section 32, a stitcher 33 and a binding line 133. A transport device 38, for example a gripper conveyor, transfers books from binding line 133 to collecting device 60, and can selectively deposit them at receipt location 64.

The collecting device 60 thus can collect books from both the first gatherer 20 and second gatherer 30 and trim the books using trimmer 24 and stack them in stacker 26.

A controller 220 controls gatherer 20 and binding line 122 via servo motor 120, and can control all the hoppers of the hopper section 22 to form or not form books as desired A controller 230 controls gatherer 30 independently and can control binding line 133 of gatherer 30 via servo motor 130. In addition, controller 220 is also connected to hopper section 32 and motor 130, so controller 220 also can controls gatherer 30 and formation of its books as desired.

During a co-mailing operation, gatherer 20 and its controller 220 acts as a host controller for both gatherer 20 and gatherer 30. Controller 220 controls the feeding of product from binding line 122 and binding line 133 to collecting device 60. Controller 220 maintains proper timing and sequencing between gatherers 20 and 30.

Books from both gatherers 20 and 30 thus can be formed and deposited at the collecting device 60 as desired. If, for example, gatherer 20 is forming a golf magazine, and gatherer 30 is forming a car magazine, and a certain recipient is to receive both magazines, controller 220 can control the hoppers 22 to be activated to form the golf magazine at a location on the binding line 122, and then be inhibited so that no book is formed on the next location on the binding line. Controller 220 can further control hopper section 32 so that a car magazine is formed so that the car magazine is delivered to location 64 when the golf magazine is delivered to location 62. As the car magazine passes location 62, the transport device 28 then does not deliver any product. The golf and car magazines can then be stacked next to each other and wrapped or otherwise processed for mailing together.

A second collecting device 70 can also be provided for the books from gatherer 30, and receive books from transport device 38 that are not delivered to collecting device 60. These books can be trimmed by a trimmer 34 and delivered to a stacker 36 via a conveyor 73. The two collecting devices 60, 70 advantageously thus provide for individual and separate operation and delivery of books from gatherers 20, 30, while collecting device 60 can collect books from both gatherers in a multiplexing operation.

A selective unlatch mechanism is used so transport device 38 drops second books at collecting device 60 or collecting device 70 as desired.

It should be noted that gatherers 20, 30 need not be the same type of gatherers, and need not be saddle stitchers, but could be perfect binders or other types of gatherers.

Moreover, products could also be trimmed together, so that for example, transport device 28 could deliver books on top of books from gatherer 30. The output could then be doubled.

Further gatherers could also be provided and permitted to deliver to collecting device 60, which then could have more receipt locations.

Figure 2:
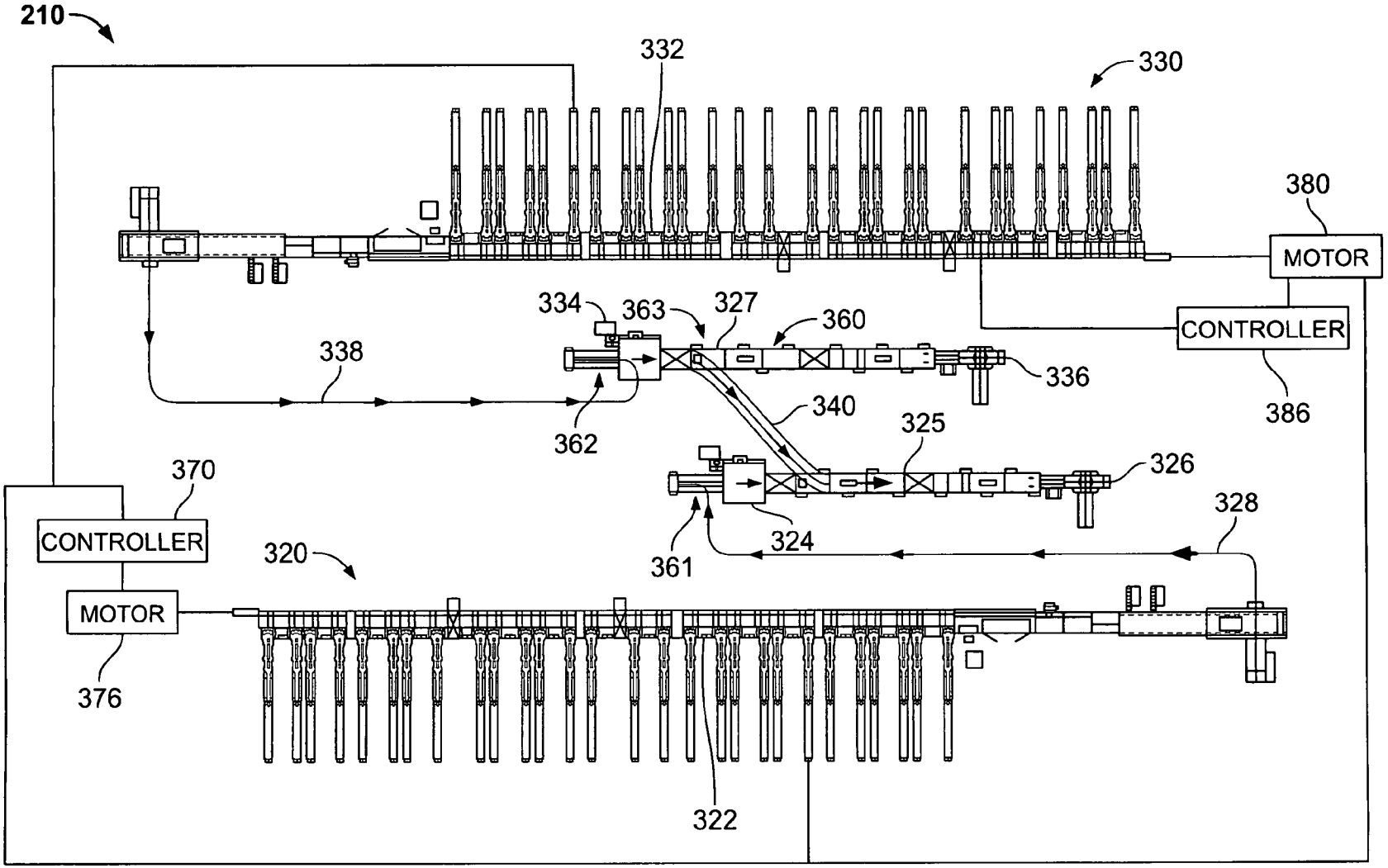
FIG. 2 shows an alternative embodiment of the gathering device according to the present invention.

FIG. 2 shows another embodiment of the present invention. Multiplexed gathering device 210 includes gatherers 320, 330. Gatherer 320 has a hopper section 322, and is controlled by a motor 376 and a controller 370. Gatherer 330 has a hopper section 332 controlled by controller 370 or alternatively by a separate controller 386. A motor 380 of gatherer 330 can be controlled by controller 386 or alternatively by controller 370. Gatherers 320 and 330 and their control can be similar to gatherers 20 and 30 of the first embodiment.

A transport device 338 can transport books from gatherer 330 to a collecting device 360 at a receipt location 362, and a transport device 328 can transport books from gatherer 320 to collecting device 360 at a receipt location 361. A trimmer 334 can trim books from gatherer 330, and a trimmer 324 can trim books from gatherer 320. Books from gatherer 330 can be transported selectively via a conveyor 327 past a switch 363 either to a stacker 336 or via a connector 340 to a conveyor 325 carrying trimmed books from gatherer 320. In that way, books from both gatherer 330 and 320 can be selectively collected in a controlled fashion on line 325 and stacked in a stacker 326, while books from gatherer 330 can selectively collected in a controlled fasion on line 327 and stacked in a stacker 336. The books thus can be collected as set by master controller 370.

Books from gatherer 330 could also be combined with books on conveyor 325 from gatherer 320, for example, by using connector 340 to place the books from gatherer 330 on top of the books on conveyor 325 from gatherer 320. This can be used to double the output of the gathering device in certain circumstances.

A variety of transport devices may be used in previously described embodiments. For example, a pin, chain or belt transport system may be used in lieu of a gripper conveyor. In addition, a divert gate, swing conveyor or flow director may be used in lieu the additional gripper drop-off.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarding in an illustrative manner rather a restrictive sense.

What is claimed is:

1. A multiplexing gathering device comprising:

a first gatherer for forming first gathered printed products on a first line;

a second gatherer for forming second gathered printed products on a second line;

a collecting device for collecting the first and second gathered printed products;

a first transporter for transporting the first gathered printed products from the first line to the collecting device;

a second transporter for transporting the second gathered printed products from the second line to the collecting device; and at least one controller for controlling the first gatherer and second gatherer so that second gathered printed products are selectively formed as a function of the formation of first gathered printed products.

2. The device as recited in claim 1 wherein the first gatherer is a saddle stitcher.

3. The device as recited in claim 1 wherein the first and second gatherers are saddle stitchers arranged in parallel with each other.

4. The device as recited in claim 1 wherein the collecting device includes a trimmer trimming the first and second printed products and a conveyor conveying the first and second printed products away from the trimmer.

5. The device as recited in claim 1 wherein the second transporter selectively transports the second gathered printed products from the second line to the collecting device and further comprising a second collecting device selectively receiving the second gathered printed products from the second gatherer.

6. The device as recited in claim 5 wherein the first and second collecting devices each includes a trimmer.

7. The device as recited in claim 1 wherein the at least one at controller includes a first controller for controlling the first gatherer and second gatherer so that second gathered printed products are selectively formed as a function of the formation of first gathered printed products and a second controller for controlling the second gatherer independently of the first controller.

8. The device as recited in claim 1 wherein the collecting device includes a first trimmer for trimming the first gathered printed products and a second trimmer for trimming the second gathered printed products.

9. The device as recited in claim 8 wherein the collecting device includes two conveyors and a connector coupled between the two conveyors.

10. The device as recited in claim 8 wherein the collecting device includes a stacker capable of receiving both the trimmed first and second gathered printed products.

11. The device as recited in claim 1 wherein the first transporter is a gripper conveyor.

12. The device as recited in claim 1 wherein the first and second transporters are gripper conveyors.

13. A method for multiplexing gathered products comprising the steps of:

forming first gathered products on a first line;

forming second gathered products on a second line as a function of the forming of the first gathered products;

transporting the first gathered products from the first line to a collecting device;

transporting the second gathered products from the second line to the collecting device; and collecting the first and second gathered products on the collecting device.

14. The method as recited in claim 13 wherein the first gathered products and the second gathered products are completely different printed products.

15. The method as recited in claim 13 wherein one of the first gathered products is collected next to one of the second gathered products on the collecting device during the collecting step.

16. The device as recited in claim 1 wherein the collecting device is downstream of the first and second gatherers.

17. The device as recited in claim 1 wherein the collecting device includes a first receipt location for receiving the first gathered printed products from the first transporter and a second receipt location for receiving the second gathered printed products from the second transporter, the first receipt location being adjacent to the second receipt location.

18. A multiplexing gathering device comprising:

a first saddle stitcher forming first gathered printed products on a first line;

a second saddle stitcher forming second gathered printed products on a second line;

a collecting device collecting the first and second gathered printed products;

a first gripper gripping the first gathered printed products at the first saddle stitcher and transporting the first gathered products from the first saddle stitcher to the collecting device;

a second gripper for gripping the second gathered printed products at the second saddle stitcher and transporting the second gathered printed products from the second saddle stitcher to the collecting device; and at least one controller for controlling the first saddle stitcher and second saddle stitcher so that second gathered printed products are selectively collected on the collecting device as a function of the collecting of the first gathered printed products on the collection device.

19. The device recited in claim 18 wherein at least one of the first saddle stitcher and the second saddle stitcher includes a plurality of hoppers.

* * * * *